United States Patent [19]

Wagner

[11] 4,170,909

[45] Oct. 16, 1979

[54] TOOL HOLDER

[76] Inventor: Theodore R. Wagner, 2590 S. Federal Blvd., Denver, Colo. 80219

[21] Appl. No.: 836,141

[22] Filed: Sep. 23, 1977

[51] Int. Cl.[2] ..... B25B 13/46

[52] U.S. Cl. ..... 81/63.2; 81/177 ST

[58] Field of Search ..... 81/63.2, 63.1, 177 M, 81/177 ST, 177.9

[56] References Cited

U.S. PATENT DOCUMENTS

| | | | |
|---|---|---|---|
| 341,986 | 5/1886 | Hapaw | 81/177 M |
| 1,250,328 | 12/1917 | Langford | 81/177 M |
| 1,578,114 | 3/1926 | Fegley | 81/177 ST |
| 1,587,647 | 6/1926 | Hood et al. | 81/177 M |

FOREIGN PATENT DOCUMENTS

| | | | |
|---|---|---|---|
| 661043 | 11/1951 | United Kingdom | 81/63.2 |

*Primary Examiner*—James L. Jones, Jr.
*Attorney, Agent, or Firm*—Paul M. Denk

[57] ABSTRACT

In a tool holder for retaining an Allen or socket wrench, or the like, during the application of manual force to the holder, the holder includes a socket being forwardly disposed and provided for reception of one of the aforementioned wrenches, the socket is rotatably held within a socket control housing, with the control being pivotally mounted to a clevis integrally formed at the forward end of the handle. In another embodiment, the handle integrally surrounds the socket control housing so as to provide a direct hold upon the tool holder. The socket control of each embodiment contains a serrated sleeve therein, with said sleeve being pressure fitted within the control, the interior of the sleeve forming a ratchet, and which ratchet acts upon a shiftable pawl provided in the downward portion of the socket, thereby providing a positive female drive for the tool holder upon any wrench held by the same.

The socket handle is elongated and contains a cavity for accommodating other tools, such as wrenches, whereas in the alternate model, the handle surrounding the socket control housing includes a slideable pin that can be laterally projecting for facilitating the application of force and resultant torque upon the tool holder and its held wrench.

34 Claims, 16 Drawing Figures

TOOL HOLDER

BACKGROUND OF THE INVENTION

This invention relates generally to wrenches, and more specifically, pertains to a tool holder capable of retaining variable size wrench components and incorporates a female type drive for enhancing the application of force and resulting torque upon any component being worked.

Innumerable style of wrenches or the like have been devised in the prior art, and usually such wrenches, particularly of the reversible type, that is, a wrench that can be caused to effect either a left hand or right hand drive, are integrally formed so that they can only accommodate a particular size nut, bolt, or other component upon which work is to be exerted. For example, the U.S. Pat. No. 4,030,384, to the inventor Newman, discloses one such hand operated ratchet wrench which is of fixed dimension and which would appear to incorporate the male form of drive. One reason for the design of the current invention, incorporating a female drive, over the customary and usually found male drive is that the main force applied from the handle to the socket member is exerted through the female control itself, rather than, as disclosed in the current invention, the main force is exerted through the female component that entirely surrounds the socket control means. Where attempts have been made to incorporate a female drive into a wrench, usually the operating components of the control are rather complex in operation, and therefore are easily susceptible to breakage, even though the wrenches may operate satisfactorily during routine usage. Such is shown in the U.S. patent to Johnson, U.S. Pat. No. 2,772,763. But, this Johnson wrench utilizes the principle of serrated pawls that are compressed into engagement with ratchet teeth by means of spring biased balls. Thus, the intricate network of such a control would appear to be rather delicate of structure as compared with the formed female drive of the current invention.

A form of male type drive is shown in the earlier United States patent to Briglia, U.S. Pat. No. 2,720,296, and this type of drive is somewhat related to the torque-applying tool device as shown in my earlier U.S. Pat. No. 3,356,117, wherein an inner gear is controlled by means of peripherally disposed locking means when forces are to be exerted in a particular direction. A similar type control and drive is also shown in the much earlier U.S. patent to Purssell, U.S. Pat. No. 1,193,716.

Another style of female drive for a ratchet wrench is shown in the U.S. patent to Sandrick, U.S. Pat. No. 3,337,014, which again incorporates the principle of the rather intricately formed internal controls that are of the pivotally disposed type for attaining directional control and force transmission from the wrench lever.

In view of the foregoing, it is the principal object of this invention to provide a female or peripheral drive for a tool holder which can accommodate a variety of wrench components, of different styles, and which exerts force upon a directional control comprising a minimum of operating components, namely, a single shiftable pawl that may be conveniently disposed to function within the ratchet means of the aforesaid type of drive member.

Another objective of this invention is to provide a tool holder of the ratchet style that may be conveniently reversed in its operating characteristics by means of a readily and conveniently disposed finger control.

A further object of this invention is to provide a tool holder for various styles of wrench means that incorporate a minimum of operating components to attain either the right or left hand drive, or even fixed retention for undertaking neither of said directional type drives.

Yet another object of this invention is to provide a convenient means for pivotally mounting the socket control housing to its handle and furnishing means for stably disposing these two components at any convenient angular direction with respect to each other so that leverage by way of manual force can be easily exerted upon the part being manipulated.

Yet another object of this invention is to provide a tool holder incorporating a handle means that is design molded having a particular style of fluted surface that has been found to acquire less physical stress from the hand of its user.

A further object of this invention is to provide an improved handle for a tool holder that is formed of a strong molded material that can yet withstand the increased forces of pressure being exerted upon it during tool application, but yet still incorporates a hollow interior for storage of a variety of the forms of wrenches that may be accommodated by its socket means.

Still another object of this invention is to provide a specially designed adapter for use in conjunction with the tool holder of this invention.

These and other objects will become more apparent to those skilled in the art upon reviewing the summary of this invention, and upon undertaking a study of the description of the preferred embodiment in view of its drawings.

SUMMARY OF THE INVENTION

This invention contemplates the formation of a tool holder useful for transmitting applied manual force in either a right hand, left hand, or stationary drive as during usage. More specifically, the tool holder is basically formed of three components, a socket means, a socket control means, as embodied in a housing and which is useful for providing the directional drive, and a convenient handle either of the palm grip type or one having some elongation for application of the entire hand and for attainment of increased force and leverage during application.

More specifically, the socket means incorporates a socket head, which may be formed as a male form of adapter for reception of various wrenches, such as a socket wrench, or the socket may be formed as a female socket which may receive a specially designed adapter for holding one of a variety of socket wrenches. In addition, and where the socket head is formed of the female configuration, it may readily receive any of a variety of Allen wrenches, screwdriver heads, Phillips head configurations, or any of a variety of various style of wrenches or other tools of varying sizes, thereby providing a tool holder of comprehensive utility and capable of meeting the immediate needs of the mechanic while working. The opposite end of the socket means incorporates a rather enlarged boss like base portion that is formed having an eccentrically disposed but transverse arranged slot therethrough, and in which a pawl is slidably retained. The socket control means is generally formed as a cylindrical member, disposed within a housing, the member having a base portion integrally formed thereof, and within the cavity of this control means there is disposed a sleeve preferably having serrations upon its outer surface so that it may be pressure inserted and retained within the control means. This sleeve, on its interiorly disposed surface, incorporates a ratchet or gear configuration, and which is conveniently disposed for reception of the edge of the sliding pawl as it is shifted to one side or the other within the base portion slot of the socket means. Due to the eccentric disposition of the pawl within the socket means, and the designed angular pitch of the teeth of the formed ratched of the socket control means, the disposition of one end of the pawl, and more particularly one of its end edges, within the ratchet teeth provides a means for forming a driving engagement for the socket means upon the application of force to the tool holder handle, whereas the spring supported pawl simply withdraws back into its slot as when the wrench handle is turned in an opposite direction, thereby providing easy reversal of the installed wrench, or other tool, for recoupment of work space in preparation for the application of additional force upon further turning of the tool, without ever necessitating the removal of the socket held tool from the part being worked, rather it be a screw, nut, bolt head, or any other type of related component.

A control shaft is axially arranged within a central channel formed through the socket means, and an adjustment means is exteriorly exposed upon the surface of the socket means but is interiorly affixed to this control shaft so that the application of a pivotal force to the adjustment means effects a turn of the control shaft, which accomplishes a shift of the slidable pawl into one direction or the other, depending upon the direction of pivot made upon the adjustment means. In any event, once the socket means, and more particularly its pawl, is shifted into an operative position engaged within the control means ratchet, the tool holder is capable of turning under excessive force, in excess of seven hundred foot pounds of pressure, in the direction of its force exerting setting. Yet, it takes little or no force to reverse the tool holder for preparation for the additional application of force, all within a fraction of a second time lapse.

The socket means control, and more specifically its housing, is formed having an integral knuckle extending in a direction opposite from its held socket means, and it is disposed for cooperating with a straddling clevis formed at one end of the tool holder handle. The handle, at this same end, incorporates a spring biased detent, such as a ball bearing, which is pressure exerted against the arcuate edge of the formed knuckle, and which knuckle may contain various spaced seats, such as shallow cavities, into which the detent may partially insert in order to affix an adjusted angular setting between the socket means and its handle. Various angular dispositions may be fixed between the socket and its handle, simply upon the application of a slight amount of force, so as to provide for a pivot of the socket control means, and more particularly its knuckle, with respect to the handle, so as to adjust the arrangement of the handle detent into that seat formed upon the outer or peripheral edge of the knuckle to provide that angular setting deemed most desirable during a particular usage of the tool holder.

The handle means itself is designed having a particular style of fluted surface, with each flute being rather truncated or trapezoidal in shape, which has been found, through experimentation, to allow the desired frictional engaging force when hand applied, without causing too great a stress upon the veins of muscles of the user's hand. In addition, and where the elongated style of handle is used in this tool holder, the handle may be formed having an internal cavity, with a removable capped end, and therein provide storage for the various style of wrenches, or other tool components, as previously analyzed. Thus, the tool holder of this invention, with its facility for storing a variety of sizes of tools within its handle, provides the only instrument needed by its user when working in situations that require the use of any size of a screw driver, Allen wrench, socket wrench, Phillips head screw driver, or any related type tools.

BRIEF DESCRIPTION OF THE DRAWINGS

In the drawings, FIG. 1 provides an isometric view of the tool holder of this invention showing its socket control means housing and socket means being disposed at various angular settings, and with the specialized adapter of this invention arranged approximate thereto.

DESCRIPTION OF THE PREFERRED EMBODIMENT

Figure 1:
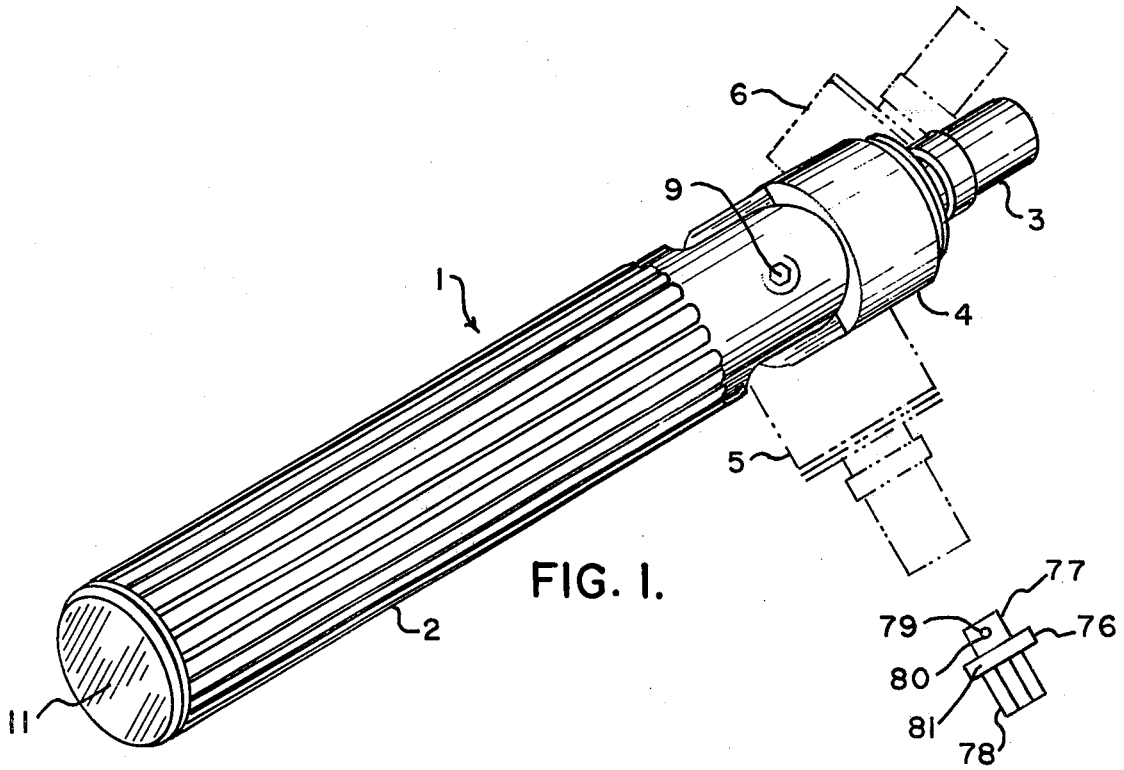
Figure 2:
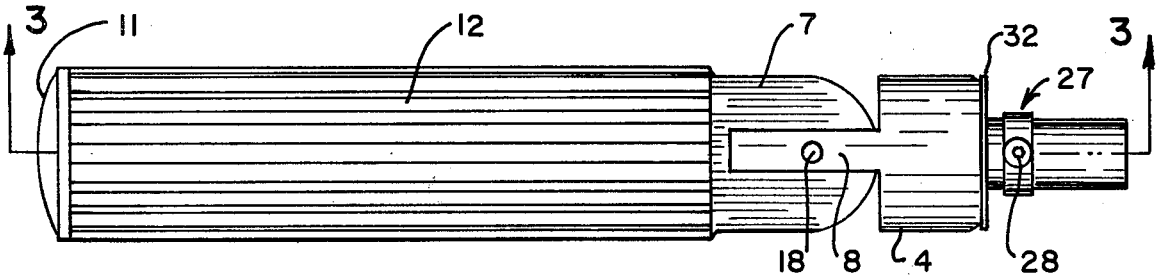
FIG. 2 provides a longitudinal side view of the tool holder of this invention, such as shown in FIG. 1.
Figure 3:
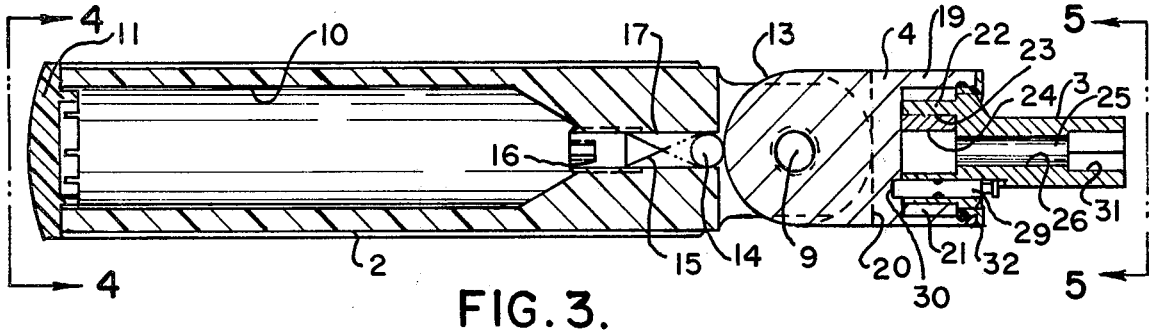
FIG. 3 furnishes a longitudinal sectional view of the tool holder of this invention, taken along the line 3—3 of FIG. 2.

In referring to FIGS. 1 through 3, there is shown the tool holder 1 of this invention, comprising a handle portion 2, a socket means 3, and a socket control means 4, as included within its housing. As can further be seen in the drawings, the combined socket and socket control means are pivotal with respect to its handle, as can be seen in the hidden line outlines depicting the arrangement of this combination approximately at 90°, as at 5, and 15° as at 6, off the longitudinal axis of the said handle. The forward end of the handle is formed having an integral clevis, as at 7, and which is designed for mating engagement with a knuckle 8 that integrally extends from the socket control means housing 4, as shown. A pin 9, and which forms the focal point or the pivotal between the socket and socket control means, and the handle 2, interconnects the clevis portion of the handle with the knuckle of the said socket control means 4.

As can also be seen in FIG. 3, the handle is inherently formed having a cavity 10 disclosed longitudinally therethrough, with a cap 11 being provided for pressure fitting for closure of the open end of the cavity 10. This cavity is useful, as previously explained, for holding other components, such as tool bits of the type previously reviewed.

Figure 4:
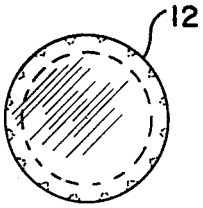
FIG. 4 provides a back end view of the tool holder, taken along the line 4—4 of FIG. 3.
Figure 5:
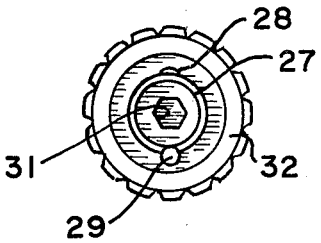
FIG. 5 provides a front end view of the tool holder of this invention taken along the line 5—5 of FIG. 3.

As can also be seen in FIG. 2, the handle is exteriorly fluted longitudinally along its length, as at 12, and each flute is preferably formed having a rather trapezoidal or truncated shape, in cross section, for the purpose of facilitating its grasp, without requiring the exertion of too much muscle compression from the hand. See also FIG. 4.

In order to maintain the adjusted angular positioning of the combined socket and socket control means with respect to handle 2 of the tool, means are provided for applying pressure against the edge, as at 13, of the knuckle portion 8 of the control means, and this is formed by means of a detent, such as the ball 14 as shown, which is biased by means of the spring 15 against the peripheral arcuate edge of the knuckle, as stated. A screw 16 is threadedly engaged within the axial aperture 17 provided through this end of the handle 2, and by further tightening or slightly withdrawing the screw 16 with respect to its threaded engagement within the aperture 17, the ball can be urged either tighter against, or lightened in its contract, with respect to the edge 13 of the said knuckle. Access to the screw 16, for adjustment purposes, can be attained by removal of the cap 11, and inserting a screw driver or the like through the cavity 10 within the handle 2. Various formed seats, one as shown at 18, may be milled into the edge of the knuckle 8, and such seats will be provided at those positions around its periphery where it is desired to provide those angular adjustments of the tool that are frequently used during its application. Thus, locating of the detent 14 within a seat 18 temporarily fixes these components at their adjusted position, as shown in FIG. 1, due to the bias of the spring constantly urging the ball 14 forwardly against the edge of the said knuckle.

The relationship between the socket means 3, and the socket control means 4 is such as to form a female type of drive for any socket wrench employed in the manner as previously analyzed within the summary of this invention. The socket control means 4, or its inherently formed housing, is formed having a cylindrical like member 19 having an integral base 20, the latter to which the knuckle 8 is integrally connected. A sleeve 21 is pressure fitted within this cylindrical formed member 19 of the control means, and to attain such the sleeve is formed having a serrated outer surface, and which serrations bite into the inner surface of the member 19 as when said sleeve is pressure fitted within the same for permanent disposition. Since the cylindrical member may be formed of aluminum, the metallic sleeve 21 can be pressure fitted into the former. The interior surface of the sleeve 21 is formed as a cylindrical ratchet, and which cooperates with the lower base portion 22 of the socket means 3, for providing the means for engagement of these two components as when the tool holder is forcefully applied for work upon a component, such as a bolt, and which same components easily disengage when the tool holder is turned in a reverse from the force exertion direction. The said lower base portion 22 of the socket means is formed having a transverse but eccentrically arranged slot 23 formed therethrough, and located for sliding within said slot is a pawl 24, as shown. Thus, a sliding of the pawl 24 in one direction achieves its engagement with the teeth of the ratchet sleeve 21, thereby allowing the exertion of force in one direction, such as a right hand direction, for turning of a bolt or the like in that direction, whereas a shifting of the pawl 24 to the opposite side of the socket means 3 causes its engagement with the ratchet sleeve 21, at approximately the other side of the socket control means, to thereby allow the tool holder to drive a bolt or the like in a left hand direction of turn. But regardless of which direction of force can be applied for exerting a turn of a component through the agency of this tool holder, when the holder is turned in a reverse direction, the pawl can slide inwardly of its slot 23 for allowing a reverse turn for recoupment of clearance of additional space in preparation for the next application of force and further work upon the component being manipulated.

As can be further seen in FIG. 3, means are provided for effecting a setting of this pawl 24 within the slot 23 of the socket means 3. This is achieved through the agency of a control shaft 25 disposed within an inner or central channel, as at 26, arranged axially through the socket means 3. An adjustment means 27, which comprises a band that is held by a threaded engagement by means of the screw 28 to the control shaft 25 provides an exteriorly exposed means that can be pivoted in one direction of turn or the other so as to effect a slide to either selected side of the pawl, and thereby furnish the direction of drive for the tool holder in preparation for its usage.

There is also provided locking means that cooperates between the socket means 3 and the socket control means 4 so as to fix these two components stationary and together as when it is desired to bypass the operations of the combined pawl 24 with respect to the ratchet sleeve 21, the latter which furnishes the directional control in the turn of the tool holder. This locking means includes a pin 29 slidingly inserted through an aperture formed within the base portion 22 of the socket means 3, and formed at the same radial distance from the center of the tool. And, within the base 20 of the socket control means is formed an aperture 30, and when proper alignment is made between the pin and this aperture 30, the pin may be forceably slid therein so as to fix these two components together, which thereby allows the application of the force in either direction to furnish a drive of the tool holder in either a right hand or left hand direction of movement for applying force to the component being worked in either selected direction.

It can also be seen that the forward end of the socket means 3 is broached, as at 31, so as to form a cavity into which various tools may be inserted, and this cavity will preferably be formed having an hexagonal or other shape so as to be readily acceptable of the base of any compatible tool to be inserted therein, such as one of the type of tools as previously explained, such as a screw driver bit, Phillips head screw driver bit, Allen wrench, or even a socket wrench amongst other type of tools.

The retention of the socket means 3 within the control socket means 4 is achieved through the agency of a fastening means, such as the snap ring 32, as shown. This snap ring may be formed of any type of sturdy material, such as a polymer, and which exhibits some slight resiliency so as to effectively attain its snap insertion within the cylindrical member 19 of the said control socket means 4. And, this cap is provided with an outer flange that is useful for retaining the socket means within the control socket means, as shown, and likewise is useful for functioning as a dust cap to prevent the entrance of any deleterious particles which could be harmful to the lasting and successful operations of this tool holder. The inner formed bevel, as at 32*a*, urges against the upper surface 32*b* of the base portion 22 to insure its retention within the socket control means 4.

Figures 6, 7, 8, 9, 10, 11:
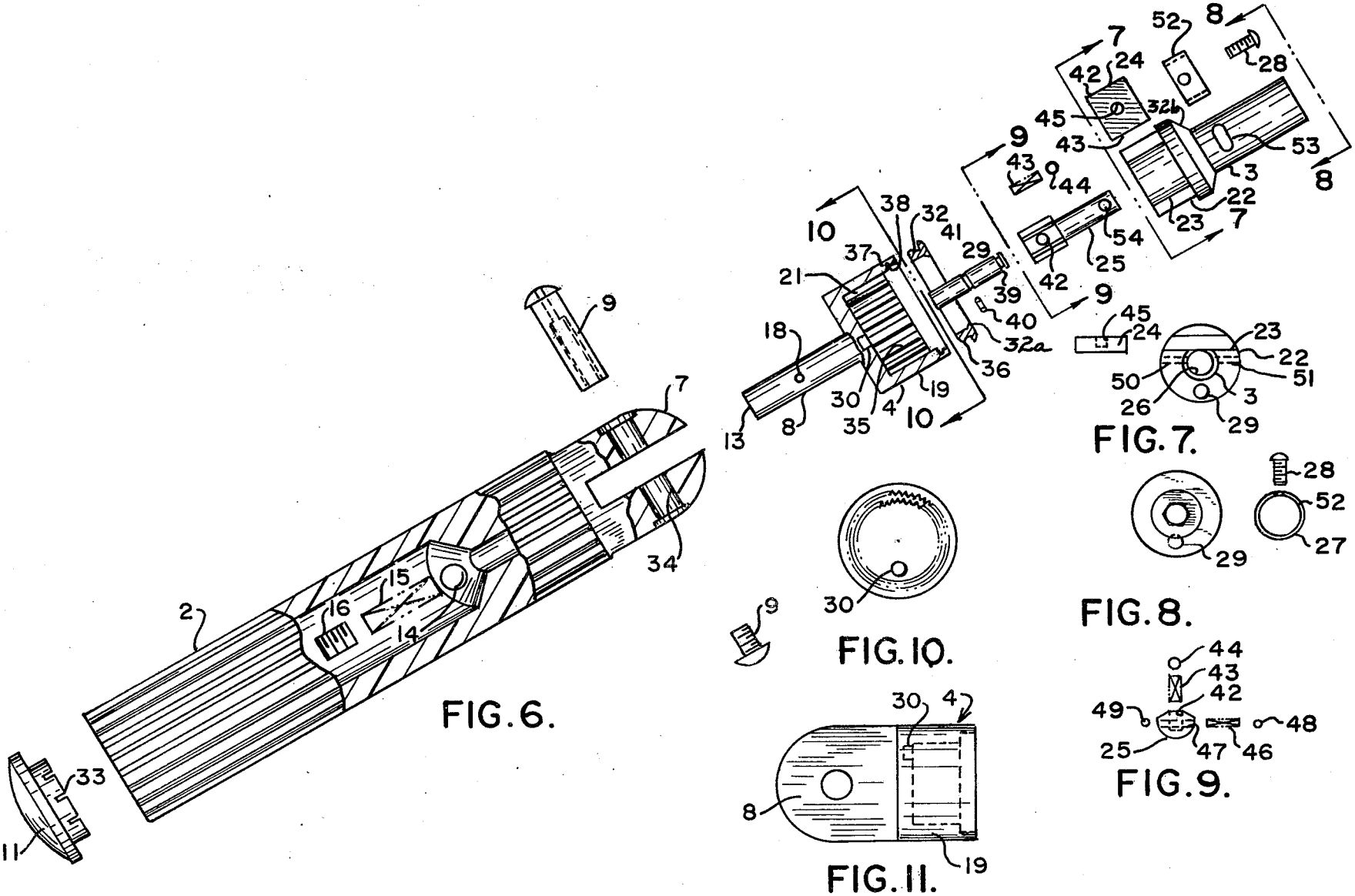
FIG. 6 depicts an exploded view of the various operating components of the tool holder of this invention.
FIG. 7 discloses an end view of the socket means of this invention taken along the line 7—7 of FIG. 6; further showing its pawl transversely displaced from its complemental slot.
FIG. 8 furnishes an opposite end view of the socket means of this invention, taken along the line 8—8 of FIG. 6, showing the adjustment means band and screw being removed from the upper portion of the same.
FIG. 9 discloses an end view of the inner control shaft of the socket means of this invention, taken along the line 9—9 of FIG. 6, further showing the displacement of the various springs and ball detents useful for cooperating with the socket means in positioning its pawl at various locations along its complemental slot.
FIG. 10 provides an end view of the socket control means and housing of this invention, taken along the line 10—10 of FIG. 6.
FIG. 11 provides a side view of the socket control means and housing, and its integral knuckle, such as shown in FIGS. 6 and 10, as aforesaid.
Figure 12:
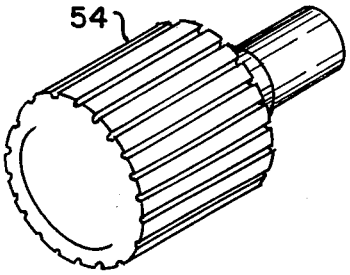
FIG. 12 furnishes an isometric view of a modified form of tool holder of this invention, being of the palm grip type.

As previously identified, an exploded view of the various components of the tool holder, showing most of the components in isolation, is provided in FIGS. 6, et al. As can be seen, the handle 2, and more specifically its cavity opening, is disposed for closure by means of the cap 11, and which cap is fluted, as at 33, to facilitate its pressure entrance or removal, from this open end of the handle. As can also be seen, the handle screw 16 cooperates with the aligned spring 15, for urging the detent ball 14 against the lower disposed edge, as at 13, of the knuckle 18. The integrally formed clevis 7 of the handle 2 is milled with a slot 34 therethrough, and through which the pin 9 inserts for holding the said control socket means knuckle 8 within the clevis spacing, as shown. It may also be commented that the fluted handle 2, and its integral clevis 7, may be formed of a polymer, molded to the shape shown, or it may be constructed of any other sturdy material, such as aluminum, and which will provide reinforcement for the tool so as to withstand the hand strength urged upon it during tool application.

The control socket means housing 4 includes the pressure inserted sleeve 21, and which forms the retention means of this invention, through the provision of the ratchet, as at 35, upon its interiorly disposed surface. The locking means pin 29 is shown aligned with the base aperture 30 as previously explained, and the depth of this aperture can be more accurately seen in FIG. 11. The snap cap 32 is formed having a circumferentially beaded portion 36, and when the cap is inserted in place into the open end of the cylindrical member 19 of the socket control means 4, such bead is intended to become secure within the formed groove 37 provided proximate the outer opening of the cavity of the said cylindrical member. In addition, the outer edge, as at 38, of this cylindrical member is formed having a slightly greater diameter than the inner diameter of the formed cavity, so that adequate clearance is provided for the initial insertion of the sleeve 21 into the said member, when it is pressure seated therein. Such clearance furnishes a convenient initial insertion for the cap 32 as it is being directed for snap fastening proximate this open edge of the control socket means.

The locking means pin 29 is provided with a grooved upper edge, as at 39, to facilitate its raising or lowering as during finger manipulation, and in addition, the O-ring 40 is disposed for seating upon the pin groove 41 so as to necessitate the use of some force to overcome the frictional disposition of said pin within the socket means 3 in order to provide for its adjustment, and to prevent its untimely self movement either into a locking or disengagement from the aperture 30 of the control socket means base.

The socket means 3 includes the widened boss like base portion 22, having its slot 23 readily receptive of the detent pawl 24 therein. This can also be seen in FIG. 7. The edges 42 and 43 of the pawl are arranged for engaging within the teeth of the ratchet 35, and depending upon which edge of the pawl is engaged with said ratchet teeth, the directional drive, that is either a right hand or left hand drive, of the tool can be regulated. But, and as previously explained, while one edge 42 may engage and bind within the ratchet 35 when the tool is turned in one direction, when the tool is turned in an opposite direction, the same edge is urged back within the base portion slot 23 as a result of its angular relationship, so as to allow for the rapid reversed turn of the socket control means with respect to the socket, as previously explained.

Provided centrally through the socket means 3 is the channel 26, and within this channel is normally disposed the inner control shaft 25. When located therein, the control shaft as can also be seen in FIG. 9, provides both the means for furnishing the shift of the pawl 24 within its slot, and likewise, furnishes temporary stops for holding the said control shaft and the pawl at a particularly set lateral location, as in the setting of the pawl to one side or the other of its slot 23. The shift of the pawl is effected through the pivoting of the control shaft 25, and the shaft contains a shallow cavity, as at 42, and into which a spring 43 seats, with said spring having a ball 44 that is pressed into the shallow aperture 45 provided centrally of the pawl 24. Thus, through this arrangement, when the control shaft 25 is pivoted in one direction or the other, the urging of its held spring 43, and ball 44 against the pawl 24 effects a shift of the pawl in either one direction or the other within the base portion slot 23 of the socket means 3. As can be seen, a bevel is provided to either side of the control shaft cavity 42 so as to provide clearance for turning of its held spring 43. See FIG. 9 once again. In addition, once the pawl undertakes the limits of its positioning to either side of the slot 23, it may be temporarily fixed in that position through the agency of a pair of stop means. Each stop means includes a spring 46 that inserts through an aperture 47 provided through the control shaft 25, and a pair of detent balls 48 and 49 are spring biased exteriorly of the said control shaft aperture and against the inner surface of the channel 26 of the control means 3. But, provided through the base portion 22 of the socket means are a pair of located apertures, as at 50 and 51, so that when the control shaft is pivoted to that extent necessary to effect a shift of the pawl 24 to its full extent to one side or the other of the slot 23, one of the balls 48 or 49 of the control shaft will seat within the inner opening of its respective apertures 50 and 51, and thereby temporarily retard the control shaft in that adjusted position. But, the application of force upon the control shaft in an opposite direction can effect an unseating of either of the balls 48 or 49, which ever one may be seated, so that this control shaft can be pivoted in an opposite direction and effect a shift of the pawl 24 to the other side of the slot 23, as may be desired, as when it is necessary to change the tool holder from a right hand drive to a left hand drive, by way of example. The means for effecting this pivoting of the control shaft 25 is effected through the previously explained adjustment means 27, and this adjustment means includes a band 52 which is normally disposed surrounding the exposed upper portion of the socket means 3, with its screw 28 extending through said band, through the slot 53 formed in the said socket means 3, and threadedly engaging within the aperture 54 formed at the upper end of the control shaft 25. It is to be noted that the slot 53 is elongated, and thereby provides the limits to the shift of the screw 28 attaining that degree of movement necessary to effect that amount of pivot to the control shaft 25 necessary to achieve a shift of its pawl 24 either to one side or the other of the slot 23. Needless to say, when the pawl 24 undertakes its positioning to either side of the said slot, either its edge 42, or its edge 43, will project slightly exteriorly of the circumferential dimension of the base portion 22 of the socket means, and provide the disposition of a certain amount of one of said edges for engagement within the teeth 35 of the ratchet sleeve 21, as previously explained.

Figure 13:
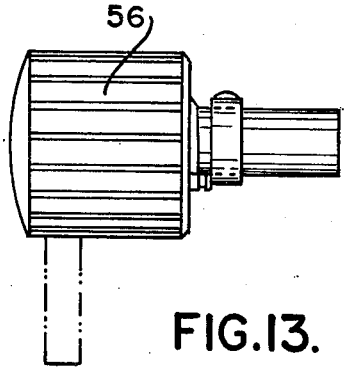
FIG. 13 provides a side view of the tool holder of FIG. 12, further disclosing, in hidden line, the extension of its leverage pin to facilitate the application of force upon the tool holder during its usage.
Figure 14:
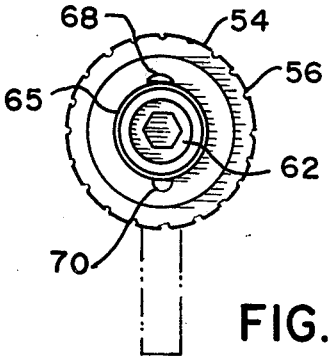
FIG. 14 discloses a front end view of the tool holder as shown in FIG. 13.
Figure 15:
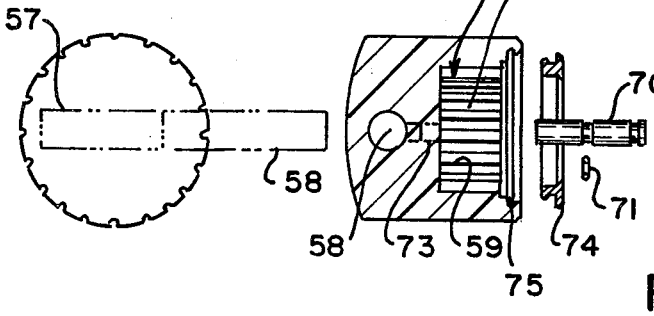
FIG. 15 furnishes a back end view of the tool holder disclosed in FIG. 13, also disclosing in hidden line the extenstion of its leverage pin; and, FIG. 16 furnishes a partial sectional and exploded view of the modified tool holder showing the operating components of its socket means and socket control means, in relative displacement.
Figure 16:
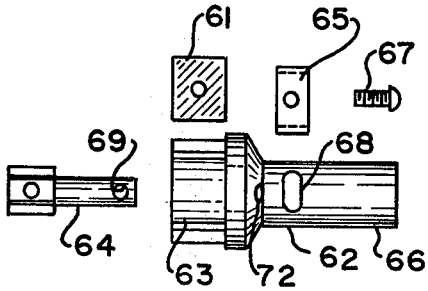

A modification in the tool holder of this invention is also shown in FIGS. 12 through 16, and this tool holder is generally configured containing the same operating components as the tool holder just previously explained, with the exception that its handle 54 is formed encompassing the socket control means, as at 55. This particular style of handle is of the type that may be grasped in the palm of the hand, and useful for applying pressure against any similar type component upon which work is to be exerted, such as a nut or bolt, or the like. This handle is also fluted, as at 56, in the manner as previously explained. A slot 57 is provided partially through the back portion of the handle 54, and a pin 58 is retained therein for sliding disposition, either within the handle slot, as when not in use, or extended outwardly thereof, as shown in FIGS. 13 through 15, so that a finger leverage may be acquired during application of a force during usage of this tool holder.

Pressure seated within the handle portion and forming a component of the socket control means is the ratchet sleeve 59 which contains a series of inner disposed teeth, as at 60, and useful for engagement with the pawl 61, in the manner as previously explained. The socket 62 includes the formed transverse but eccentrically arranged slot 63 and into which the pawl 61 may insert, with the said pawl 61 being shiftable to either side of the socket means through the agency of the control shaft 64, in the manner as previously explained with respect to the control shaft 25 of the earlier described embodiment. The band 65 is designed for surrounding the exteriorly exposed portion 66 of the socket means 62, with its screw 67 extending through the elongated slot 68 for fastening with the threaded aperture 69 of the control shaft 64. The lower end of the control shaft is designed for cooperating through the agency of springs and various detents with the pawl 61 in the manner as previously explained for both effecting the shifting of said pawl within its slot 63, and likewise to resiliently hold it in position through the agency of stop means as previously explained with respect to the FIG. 9 equivalent embodiment. The locking means 70, with its O-ring 71, is disposed for insertion through the aperture 72, formed through the socket means 62, and this locking means includes a pin that may be inserted within a slot 73 formed in the base of the handle means 56. And, in the assembly of this described tool holder, the snap ring 74 is designed for engaging within the groove 75 arranged proximate the opening of the cavity into the control socket means 55, and in that manner secure the said control socket means 62 in place within its control means.

It may be commented that a specially designed adapter, as at 76, has been made for enhancing the utility of this tool. This adapter 76, as shown in FIG. 1, includes an insertable portion 77, disposed for insertion within the broached end 31 of the socket means of this invention. The exposed end 78 may have a hexagonal or square configuration, and onto which any form of socket wrench, as generally available in the trade, may insert. To assist in the retention of the insertable end 77 within the broached end 31 of the socket means, an aperture, as at 79 is provided through this member, and a polymeric or elastomeric material is located therein, as at 80, and extends partially out of the same, so as to provide for frictional engagement between this adapter as it inserts within its respective socket means. A shoulder 81 is formed integrally of this adapter so as to limit the extent of its insertion within its applied socket means.

Various modifications to this invention may occur to those skilled in the art upon reviewing the subject matter of this invention. Any such modifications, if within the spirit of this invention, and encompassed by the scope of the claims, are intended to be protected by a United States patent issuing upon this invention. The description of the preferred embodiment is set forth to describe and illustrate the components and operation of the invention, and is not intended to be limiting of the described invention.

Having thus described the invention what is claimed and desired to be secured by Letters Patent is:

1. A tool holder for use in transmitting applied manual force to its held tool comprising a socket means, said socket means provided for accommodating a tool, socket control means holding said socket means and furnishing directional rotation for the said socket means and its tool upon use of the tool holder, a handle means, said handle means having the socket control means connected therewith and capable of maintaining an angular relationship with said control means for enhancing the application and transfer of force during the tool holder usage, a sleeve fixedly arranged within said socket control means, said sleeve having a series of retention means provided around its interior, said socket means being inserted within said sleeve in cooperating with said sleeve retention means for preventing a turn of the said socket means in one direction as during application of a force, while freely providing a reverse turn of the said socket means in preparation for the exertion of additional force during usage of the said combined tool holder and its held tool, fastening means cooperating within the socket control means for securing the said socket means within the same, said socket control means including a cylindrical member having a central cavity provided therein, said retention means sleeve being fixedly secured within the said member cavity, the series of retention means formed of the sleeve forming a ratchet, said socket means formed having an integral base portion, a pawl shiftably associated with said base portion and capable of movement into engagement with the said ratchet and retard socket means rotation at least in one direction, said base portion having an eccentrically transverse arranged slot formed therethrough and being of a size to accommodate the insertion of the said pawl therein, said pawl capable of shifting in opposing directions within the said formed slot, the shift of said pawl from one side and its engagement with the said ratchet preventing a rotation of the socket means in one direction, while a shifting of the said pawl to the other side and its engagement thereat with the said ratchet precluding a rotation of the socket means in an opposite direction, an adjustment means provided exposed upon the socket means above its integrally formed base portion, whereupon a manipulation of the said adjustment means effects a shifting of the said pawl to one of the said sides of the base portion of the socket means, said socket means including a central channel axially arranged therethrough, a shaft provided within said channel, said adjustment means including a band, said band being fixed to said shaft, means operatively associated between the said shaft and pawl, whereby a pivot of the said band translates into a shift of the pawl to one of said sides of the socket means base portion and its fixation by means of its intermeshing with the control means ratchet.

2. The invention of claim 1 and including said handle means coupled to said control socket means, a clevis integrally projecting from one end of the handle means, and an integral knuckle extending from the base of the control socket means, a pin extending through said clevis and knuckle to hold said components pivotally together, means cooperating between the said knuckle and the approximate end of the handle means to temporarily fix the socket control means at an adjusted angular position with respect to said handle means, said means including at least one seat provided upon the edge of the knuckle, a detent extending from the proximate end of said handle means, said detent comprising a ball, a spring inserted within the end of said handle means and having the ball resting thereon, said spring constantly urging its ball against the edge of the said knuckle, a screw extending through the end of a handle means and cooperating with said spring within a handle end, the adjustment of said screw regulating the pressure of the ball against the knuckle edge.

3. The invention of claim 1 wherein said socket control means includes an integral base for its cylindrical formed member, there being an aperture provided within said base, said socket means formed having an integral base portion, said socket means base portion normally directionally rotatable within the retention means sleeve, and locking means provided upon the said base portion of the socket means and when extended engaging within the said base aperture for fixing the socket means against any rotation with respect to the control means.

4. The invention of claim 3 wherein said socket means base portion is formed having an aperture provided therein, said locking means comprising a pin slidingly inserted through said aperture, said pin capable of alignment with the control means base aperture and shifting therein so as to fix the socket means against rotation with respect to the socket control means.

5. The invention of claim 4 and including an O-ring surrounding said pin to provide frictional resistance against its slidable movement within the said base portion of the control means.

6. The invention of claim 1 and including a screw fixing the band to the said shaft.

7. The invention of claim 6 wherein said socket means includes a slot provided through to its central channel, the said band screw arranged through the formed slot for securement to the said shaft, with the limits of pivot of the said band being defined by the limits of movement of the said screw within the formed slot.

8. The invention of claim 1 wherein the means associated between the shaft and pawl comprises a spring, said spring providing for a cushioned shifting of the said pawl within the socket means base portion.

9. The invention of claim 8 wherein there being clearance provided between the said shaft and the pawl proximate the location of said spring to provide for unencumbered shifting of the said pawl within the base portion slot.

10. The invention of claim 9 and including stop means provided cooperating between the shaft and the contiguous socket means base portion to maintain the setting of the pawl when adjusted to either side of its slot.

11. The invention of claim 10 wherein said stop means includes at least one void provided in one of the base portion and shaft, there being an aperture provided in the other of said shaft and base portion, a spring seated within the formed aperture, a detent aligned against the spring and urged toward the said void, whereby upon alignment of the said void and detent the detent enters therein to temporarily retard relative movement between the shaft and its contiguous base portion.

12. The invention of claim 1 wherein said handle means has a central cavity provided within its interior and opening at its end opposite from the location of its integral clevis or knuckle, a cap provided for closure of said cavity opening, whereby tool storage may be accommodated within the said formed handle means cavity.

13. The invention of claim 12 wherein said handle means is exteriorly fluted to facilitate its grasp.

14. The invention of claim 13 wherein each handle means flute is truncated in cross section.

15. The invention of claim 1 and wherein said socket means being designed for holding an Allen wrench.

16. The invention of claim 1 wherein said socket means being designed for holding a socket wrench.

17. The invention of claim 16 and including an adapter useful for facilitating the hold of the socket wrench to the socket means.

18. The invention of claim 17 wherein said adapter includes a member for insertion within the socket means, an aperture provided through said member, an elastomeric material provided within said adapter aperture and extending partially outwardly therefrom for furnishing a frictional engagement and retention of the adapter within the socket means.

19. A tool holder for use in transmitting applied manual force to its held tool comprising a socket means, said socket means provided for accomodating a tool, socket control means holding said socket means and furnishing directional rotation for the said socket means and its tool upon use of the tool holder, a handle means, said handle means formed completely surrounding the side and end of the said socket control means to facilitate its grasp during usage, a sleeve fixedly arranged within said socket control means, said sleeve having a series of retention means provided around its interior, said socket means being inserted within the said sleeve and cooperating with the said sleeve retention means for preventing a turn of the said socket means in one direction as during application of a force, while freely providing a reverse turn of the said socket means in preparation for the exertion of additional force during usage of the said combined tool holder and its held tool, fastening means cooperating within the socket control means for securing the said socket means within the same, said socket control means including a cylindrical member having a central cavity provided therein, said retention means sleeve being fixedly secured within the said member cavity, said series of retention means formed of the sleeve forming a ratchet, said socket means formed having an integral base portion, a pawl shiftably associated with said base portion and capable of moving into engagement with the said ratchet to retard socket means rotation at least in one direction, said base portion having an eccentrically arranged transfer slot formed therethrough and being of a size to accommodate the insertion of the said pawl therein, said pawl capable of shifting in opposing directions within the said formed slot, whereby the shifting of the said pawl to one side and its engagement with the said ratchet preventing a rotation of the socket means in one direction, while a shifting of the said pawl to the other side and its engagement thereat with the said ratchet precluding a rotation of the socket means in an opposite direction, said tool holder being reversible in its operations, adjustment means provided exposed upon the said socket means above its integrally formed base portion, whereupon a manipulation of the said adjustment means effecting a shifting of the said pawl to one of the said sides of the base portion of the socket means, said socket means including a central channel axially arranged therethrough, a shaft provided within the said channel, said adjustment means including a band, said band being fixed to the said shaft, means operatively associated between the said shaft and pawl, whereby a pivot of the said band translates into a shift of the pawl to one of said sides of the socket means base portion and its fixation by means of its intermeshing with the control means ratchet.

20. The invention of claim 19 and including a pin shiftable transversely from within the handle means to facilitate the application of force upon the tool holder during its usage.

21. The invention of claim 20 wherein the handle is exteriorly fluted to facilitate its grasp.

22. The invention of claim 21 wherein each handle flute is truncated in cross section.

23. The invention of claim 19 wherein said socket control means includes an integral base for its cylindrical formed member, there being an aperture provided within said base, said socket means formed having an integral base portion, said socket means base portion normally directionally rotatable within the retention means sleeve, and locking means provided upon the said base portion of the socket means and when extended engaging within the said base aperture for fixing the socket means against any rotation with respect to the control means.

24. The invention of claim 23 wherein said socket means base portion is formed having an aperture provided therein, said locking means comprising a pin slidingly inserted through the said aperture, said pin capable of alignment with the control means base aperture and shifting therein so as to fix the socket means against rotation with respect to the socket control means.

25. The invention of claim 19 and including a screw fixing the band to the said shaft.

26. The invention of claim 25 wherein said socket means includes a slot provided through to its central channel, the said band screw arranged through the formed slot for securement to the said shaft, with the limits of pivot of the said band being defined by the limits of movement of the said screw within the formed slot.

27. The invention of claim 19 wherein the means associated between the shaft and pawl comprises a spring, said spring providing for a cushioned shifting of the said pawl within the socket means base portion.

28. The invention of claim 27 wherein there being clearance provided between the said shaft and the pawl proximate the location of said spring to provide for unencumbered shifting of the said pawl within the base portion slot.

29. The invention of claim 28 and including stop means provided cooperating between the shaft and the contiguous socket means base portion to maintain the setting of the pawl when adjusted to either side of its slot.

30. The invention of claim 29 wherein said stop means includes at least one void provided in one of the base portion and shaft, there being an aperture provided in the other of said shaft and base portion, at least one spring seated within the formed aperture, at least one detent aligned against the spring and urged toward the said void, whereby upon alignment of the said void and detent, the detent enters therein to temporarily retard relative movement between the shaft and its contiguous base portion.

31. The invention of claim 19 and wherein said socket means being designed for holding an Allen wrench.

32. The invention of claim 19 wherein said socket means being designed for holding a socket wrench.

33. The invention of claim 32 and including an adapter useful for facilitating the hold of the socket wrench to the socket means.

34. The invention of claim 33 wherein said adapter includes a member for insertion within the socket means, an aperture provided through said member, an elastomeric material provided within said adapter aperture and extending partially outwardly therefrom for furnishing a frictional engagement and retention of the adapter within the socket means.

* * * * *